US011844745B2

(12) United States Patent
Smoke

(10) Patent No.: US 11,844,745 B2
(45) Date of Patent: Dec. 19, 2023

(54) PILL REGULATOR APPARATUS

(71) Applicant: Arthur Smoke, Whiting, NJ (US)

(72) Inventor: Arthur Smoke, Whiting, NJ (US)

( * ) Notice: Subject to any disclaimer, the term of this patent is extended or adjusted under 35 U.S.C. 154(b) by 0 days.

(21) Appl. No.: 17/412,624

(22) Filed: Aug. 26, 2021

(65) Prior Publication Data

US 2022/0062102 A1 Mar. 3, 2022

Related U.S. Application Data

(60) Provisional application No. 63/070,548, filed on Aug. 26, 2020.

(51) Int. Cl.
*A61J 1/03* (2023.01)
*B65D 25/04* (2006.01)

(52) U.S. Cl.
CPC ..... *A61J 1/03* (2013.01); *B65D 25/04* (2013.01)

(58) Field of Classification Search
CPC .. A61J 7/04; A61J 1/03; A61J 2205/30; A61J 7/0084; B65D 25/04
See application file for complete search history.

(56) References Cited

U.S. PATENT DOCUMENTS

| | | | | |
|---|---|---|---|---|
| 5,351,818 | A * | 10/1994 | Daneshvar | A61J 7/0084 206/534 |
| 6,581,797 | B2 | 6/2003 | McKinney, Jr. et al. | |
| D486,010 | S | 2/2004 | Scola | |
| 7,555,995 | B1 | 7/2009 | Stump et al. | |
| 7,571,811 | B2 | 8/2009 | Mulaw | |
| 7,624,890 | B2 * | 12/2009 | Noble | B65D 83/0445 206/538 |
| 8,763,553 | B1 | 7/2014 | Shannehan et al. | |
| 2009/0166243 | A1 * | 7/2009 | Cetera | A61J 1/03 206/459.5 |
| 2014/0251863 | A1 * | 9/2014 | Priebe | A61J 1/03 206/534 |
| 2016/0375201 | A1 * | 12/2016 | Knaub | B65D 83/0038 221/131 |

* cited by examiner

*Primary Examiner* — Shawn M Braden
(74) *Attorney, Agent, or Firm* — Boudwin Intellectual Property Law, LLC; Daniel Boudwin

(57) ABSTRACT

A pill regulator apparatus is defined by a base. A number of side walls, including a rear wall, a front wall, and a pair of opposing side walls. The front wall, rear wall and opposing side walls define an interior volume. A number of dividing walls are installed within the interior volume so that a number of individual compartments are defined. A number of tabs are placed above the individual compartments on the rear wall. Each individual compartment includes a corresponding tab. Each tab is movable between an upward position and a downward position.

7 Claims, 4 Drawing Sheets

PILL REGULATOR APPARATUS

CROSS REFERENCE TO RELATED APPLICATIONS

This application claims the benefit of U.S. Provisional Application No. 63/070,548 filed on Aug. 26, 2020. The above identified patent application is herein incorporated by reference in its entirety to provide continuity of disclosure.

BACKGROUND OF THE INVENTION

The present invention relates to a medication regulator. More specifically, the present invention provides a medication bottle storage and reminder device designed to assist a user in storing medication and reminding him or her of the time period in which to take the medication.

Medications are commonly utilized to treat both chronic and acute medical conditions. Some individuals, such as older individuals and individuals with certain pre-existing medical conditions, may be required to take multiple medications during the week. As medications vary in their chemical composition and dosage, they also commonly vary in their ingestion instructions. Tor example, some medications may be required to be taken multiple times a day. On the other hand, some medications may be required to be taken every other day. As an individual is prescribed more and more medications, it is unlikely that they will be able to remember exactly when to take each specific medication.

To combat this problem, there have been devices that were invented to provide multiple compartments to store different kinds of medications. These devices normally provide a number of identical compartments that may be opened and closed to access the medication stored therein. These compartments may be labeled by a day of the week or by the actual medication name. These devices generally do not provide a mechanism by which an individual may be able to keep track of the pills that they have taken.

SUMMARY OF THE INVENTION

In view of the foregoing disadvantages inherent in the known types of medication reminder methods and systems now present, in the prior art, the present invention provides a pill regulator apparatus wherein the same can be utilized for providing convenience for the user when providing a mechanism to track and remind users of medication timing.

The present system comprises a base. A plurality of side walls extends upward from the base. The plurality of side walls comprise a front wall disposed opposite a rear wall and a pair of opposing side walls defined between the front wall and the rear wall. The front wall, rear wall, and opposing side walls define an interior volume therebetween. A plurality of dividing walls is disposed within the individual compartments. A plurality of tabs is disposed on a top end of the rear wall. Each tab of the plurality of tabs corresponds to an individual compartment of the plurality of individual compartments. Furthermore, each tab is movable between an upward position and a downward position.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
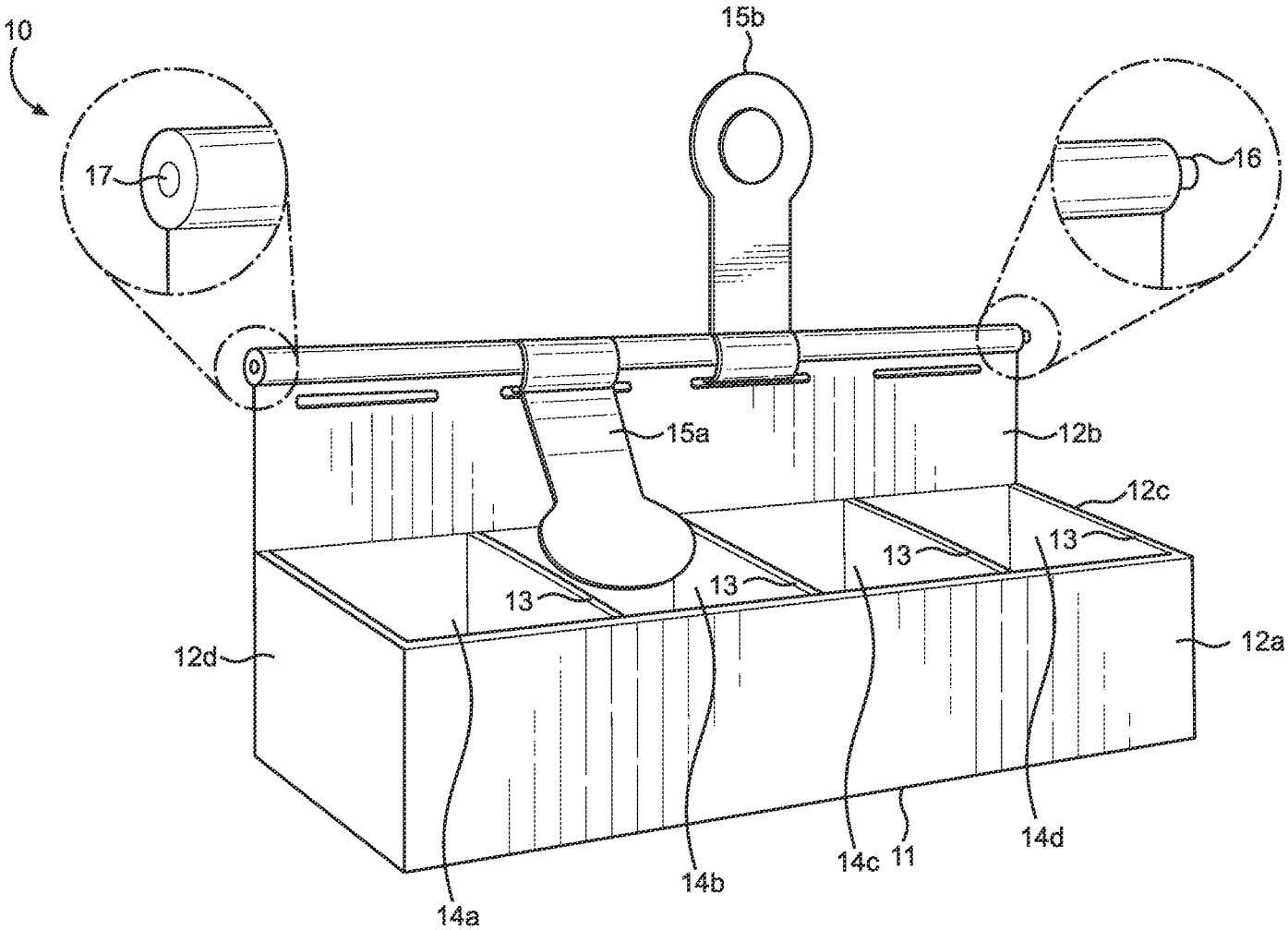
FIG. 1 shows a perspective view of an embodiment of the pill regulator apparatus.

Reference is made herein to the attached drawings. Like reference numerals are used throughout the drawings to depict like or similar elements of the pill regulator apparatus. The figures are intended for representative purposes only and should not be considered to be limiting in any respect.

Referring now to FIG. 1, there is shown a perspective view of an embodiment of the pill regulator apparatus. The pill regulator apparatus 10 comprises a base 11. In the illustrated embodiment, the base 11 is flat, such as to enable the pill regulator apparatus 10 to be placed upon a flat surface, such as a counter or a nightstand. In alternate embodiments, the base 11 may be of an alternate structure to enable placement in a different position.

A plurality of side walls 12*a*, 12*b*, 12*c*, 12*d* extend upward from the base. The plurality of side walls 12*a*, 12*b*, 12*c*, 12*d* and the base 11 define an interior volume, with an opening defined opposite the base 11. The plurality of side walls 12*a*, 12*b*, 12*c*, 12*d* comprises a front wall 12*a* disposed oppositely a rear wall 12*b* and a pair of opposing side walls 12*c*, 12*d*. In the specifically demonstrated embodiment, the plurality of side walls 12*a*, 12*b*, 12*c*, 12*d* consists of a front wall 12*a* disposed oppositely a rear wall 12*b* and a pair of opposing side walls 12*c*, 12*d*. In the illustrated embodiment, the front wall 12*a* and the rear wall 12*b* are of an identical length, while the pair of opposing side walls 12*c*, 12*d* are also of an identical length, such that the pill regulator apparatus 10 enables placement of a plurality of pill containers in a linear fashion, allowing access to each from the front wall 12*a*. Alternatively, the relative sizes and dimensions of the plurality of side walls 12*a*, 12*b*, 12*c*, 12*d* may be modified for any desired purpose or use.

A plurality of dividing walls 13 are disposed within the interior volume. The plurality of diving walls 13 are configured to define a plurality of individual compartments 14*a*, 14*b*, 14*c*, 14*d*. In the illustrated embodiment, the plurality of individual compartments 14*a*, 14*b*, 14*c*, 14*d* are dimensioned to receive a pill container or a pill bottle therein, in the illustrated embodiment, the plurality of individual compartments 14*a*, 14*b*, 14*c*, 14*d* are of an identical volume. As such, the pill regulator apparatus 10 may be utilized to store pill bottles and pill containers of identical or similar circumferences.

The pill regulator apparatus 10 further comprises a plurality of tabs 15*a*, 15*b*. The plurality of tabs 15*a*, 15*b* are disposed on a top end of the rear wall 12*b* of the plurality of side walls 12*a*, 12*b*, 12*c*, 12*d*. The number of tabs of the plurality of tabs 15*a*, 15*b* corresponds to the number of individual compartments 14*a*, 14*b*, 14*c*, 14*d* which are to be utilized by the user. In the illustrated embodiment, the plurality of tabs 15*a*, 15*b* are each centrally disposed over the corresponding individual compartment 14*b*, 14*c* (respectively). As such, each tab may be utilized to signal a status of the pill container of each individual compartment.

The plurality of tabs 35*a*, 15*b* are configured to be removable from the rear wall 12*b*. In the illustrated embodiment, the plurality of tabs 15*a*, 15*b* are secured to the rear wall via the insertion of a rod 16 through a channel 37 defined on the top of the rear wall 12*b*. As such, the user may select the number of tabs 15*a*, 15*b* which are installed upon the pill regulator 10. A user may wish to add or remove tabs 15*a*, 15*b* depending on the number of pill containers or pill bottles stored within the pill regulator apparatus 10. Each tab of the plurality of tabs is rotatable between an upward position (demonstrated by the second tab 12*b*) and a downward position (demonstrated by the first tab 12*a*).

Figure 2:
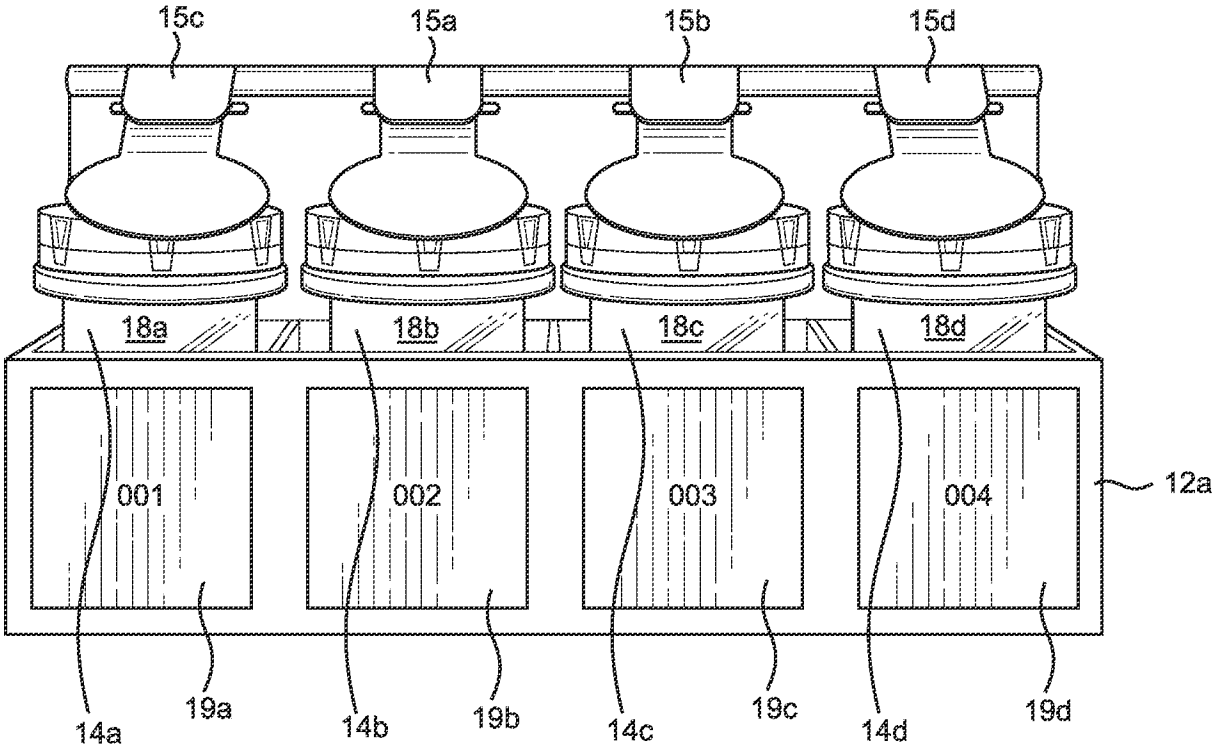
FIG. 2 shows a first demonstrative view of an embodiment of the pill regulator apparatus.

Referring now to FIG. 2, there is shown a first demonstrative view of an embodiment of the pill regulator apparatus. In use, the pill regulator apparatus may store a plurality of pill containers 18*a*, 18*b*, 18*c*, 18*d*. As illustrated, a first pill container 18*a* is disposed in a first individual compartment 14*a*, a second pill container 18*b* is disposed in a second individual compartment 14*b*, a third pill container 18*c* is disposed in a third individual compartment 14*c*, and a fourth pill container 18 *d* is disposed in a fourth individual compartment 14*d*. Furthermore, in the demonstrated embodiment, each individual compartment 14*a*, 14*b*, 14*c*, 14*d* comprises a corresponding tab 15*a*, 15*b*, 15*c*, 15*d*. In the illustrated embodiment, each tab 15*a*, 15*b*, 15*c*, 15*d* is placed into the downward position. The downward position is defined where the distal end of the tab 15*a*, 15*b*, 15*c*, 15*d* is oriented downward, such as to be in contact with the pill container 18*a*, 18*b*, 18*c*, 18*d* in the corresponding individual compartment 14*a*, 14*b*, 14*c*, 14*d*. In the illustrated embodiment, a plurality of labels 19*a*, 19*b*, 19*c*, 19*d* are disposed on the front face of the front wall 12*a*. The plurality of labels 19*a*, 19*b*, 19*c*, 19*d* are utilized to identify the contents of the pill container 18*a*, 18*b*, 18*c*, 18*d* of the corresponding individual compartment 14*a*, 14*b*, 14*c*, 14*d*. The plurality of labels 19*a*, 19*b*, 19*c*, 19*d* may be removable from the front wall 12*a* or may be erasable, such as to allow the user to erase and rewrite information thereon.

Figure 3:
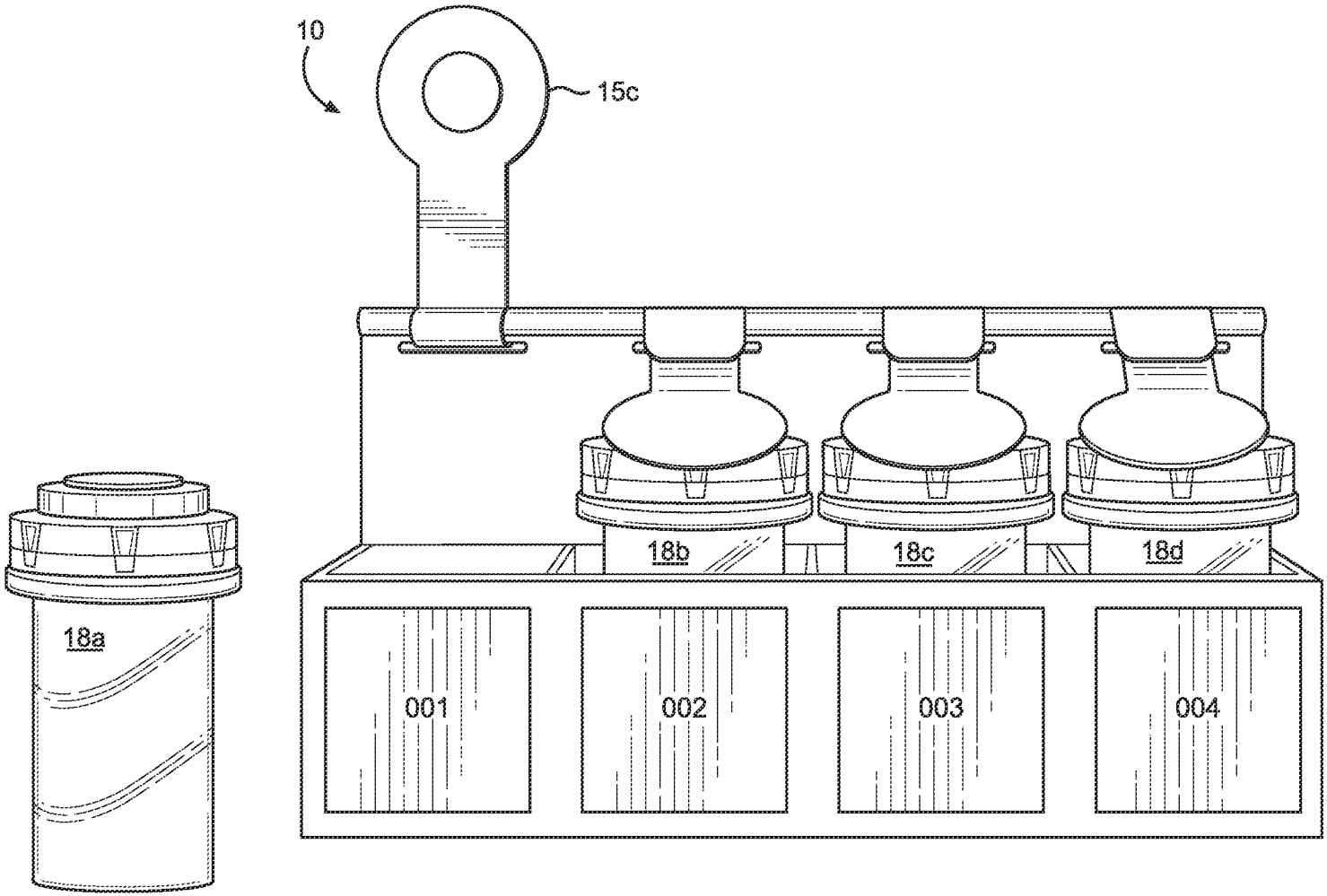
FIG. 3 shows a second demonstrative view of an embodiment of the pill regulator apparatus.

Referring now to FIG. 3, there is shown a second demonstrative view of an embodiment of the pill regulator apparatus. In the course of the day for the user, he or she will need to utilize the pill containers 18*a*, 18*b*, 18*c*, 18*d* disposed within the pill regulator device 10. In the illustrated embodiment, the first pill container 18*a* has been removed from the pill regulator device 10. In order to remove the first container 18*a*, the first tab 15*c* was moved into the upward position. The upward position is defined where the tab 15*c* is placed in a substantially vertical position relative to the pill regulator device 10. In some embodiments, a stopper, a clip or a similar device may be utilized to maintain the tab 15*c* in an upward position.

Figure 4:
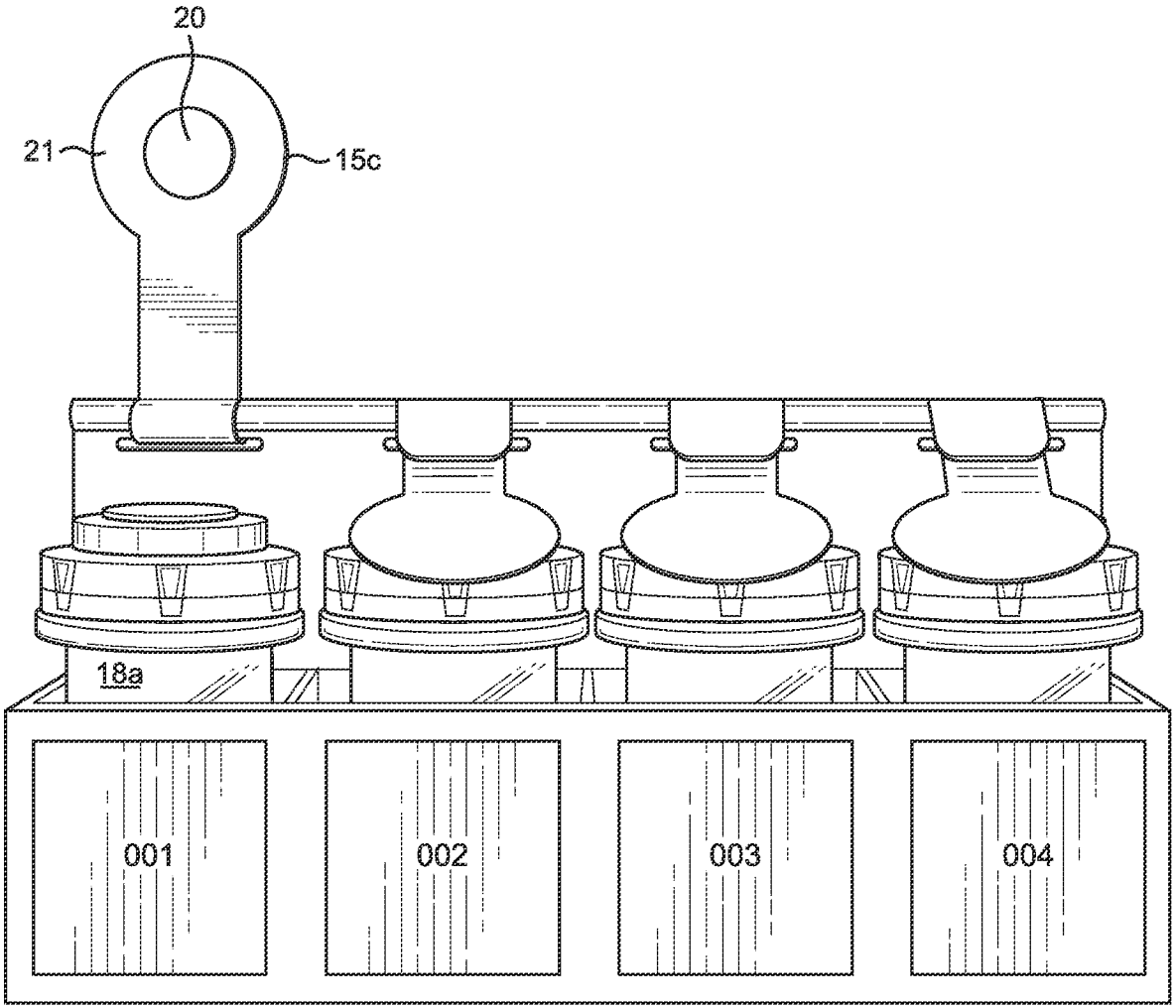
FIG. 4 shows a third demonstrative view of an embodiment of the pill regulator apparatus.

Referring now to FIG. 4, there is shown a third demonstrative view of an embodiment of the pill regulator apparatus. Once the medication is consumed by the user, the user may place the pill container within the corresponding individual compartment 14*a*. Because the tab 15*c* has been placed into the upward position, the user will be reminded, upon returning for an additional medication that he or she has already taken a dose of the first pill container 18*a*.

In the illustrated embodiment, each tab 15*c* comprises a circular protrusion 20 disposed at a distal end thereof. The circular protrusion 20 is configured to assist the tab 15*c* in resting upon the pill container 18*a*, as well as increasing the visual profile of the tab 15*c*, such that the tab 15*c* will more effectively notify the user of having taken a dose of the first pill container 18*a*. Additionally, in the illustrated embodiment, the tab 15*c* comprises an identifier 21 placed on the underside surface of the tab 15*c*. The identifier 21 is of a different color than the tab 15*c*, such as to increase the visual profile of the tab 15*c* when the tab 15*c* is in the upward position. Because of the placement of the identifier 21 on the underside surface of the tab 15*c*, the identifier 21 is not visible when the tab 15*c* is in the downward position.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A pill regulator apparatus, comprising:

a base;

a plurality of side walls extending upward from the base;

the plurality of side walls comprising a front wall disposed opposite a rear wall and a pair of opposing side walls disposed between the front wall and the rear wall;

the front wall, the rear wall, and the opposing side walls defining an interior volume therebetween;

a plurality of dividing walls disposed within the interior volume;

the plurality of dividing walls defining a plurality of individual compartments;

a plurality of tabs removably disposed on a top end of the rear wall;

each tab of the plurality of tabs corresponding to an individual compartment of the plurality of individual compartments;

each tab movable between an upward position and a downward position;

wherein the plurality of tabs is secured to the top end of the rear wall via insertion of a rod through a channel defined on top of the rear wall;

wherein each tab comprises a circular protrusion disposed upon a distal end of the tab; and wherein a plurality of labels is disposed on the front wall of the plurality of side walls.

2. The pill regulator apparatus of claim 1, wherein the base is flat.

3. The pill regulator apparatus of claim 1, wherein the rear wall is of a greater height than the front wall.

4. The pill regulator apparatus of claim 1, wherein each individual compartment of the plurality of individual compartments is identical in size and dimension.

5. The pill regulator apparatus of claim 1, wherein each individual compartment of the plurality of individual compartments is dimensioned to receive a pill bottle therein.

6. The pill regulator apparatus of claim 1, wherein each tab of the plurality of tabs is centrally disposed above each corresponding individual compartment.

7. The pill regulator apparatus of claim 1, wherein an identifier is disposed on an underside surface of each tab.

* * * * *